United States Patent [19]

Nix et al.

[11] 4,284,320

[45] Aug. 18, 1981

[54] ELECTRICAL CONNECTOR

[75] Inventors: Lothar H. W. Nix, Walldorf; John Heinrich, Rodgau, both of Fed. Rep. of Germany

[73] Assignee: AMP Inc., Harrisburg, Pa.

[21] Appl. No.: 55,090

[22] Filed: Jul. 5, 1979

[30] Foreign Application Priority Data

Jul. 27, 1978 [GB] United Kingdom ..... 31363/78

[51] Int. Cl.[3] ..... H01R 13/506

[52] U.S. Cl. ..... 339/200 R; 339/210 M

[58] Field of Search ..... 339/103 M, 206 R, 210 R, 339/210 M

[56] References Cited

U.S. PATENT DOCUMENTS

| | | | |
|---|---|---|---|
| 3,525,972 | 6/1970 | Asick et al. | 339/206 R X |
| 3,573,720 | 4/1971 | Reynolds | 339/217 |
| 4,080,041 | 3/1978 | Hawkins | 339/210 M |
| 4,130,330 | 12/1978 | Chandler | 339/103 M X |
| 4,190,952 | 3/1980 | Thomas et al. | 339/99 R X |

FOREIGN PATENT DOCUMENTS

| | | | |
|---|---|---|---|
| 1912825 | 10/1970 | Fed. Rep. of Germany | 339/210 M |

*Primary Examiner*—Eugene F. Desmond

*Attorney, Agent, or Firm*—David C. Ripma; Jay L. Seitchik; Russel J. Egan

[57] ABSTRACT

An electrical connector housing is formed of two relatively slidable parts movable between a condition in which contact cavities are aligned, for insertion of contacts and a condition in which the cavities are slightly out of alignment so that one housing part presents shoulders overlapping edges of cavities in the other part for positively retaining contacts in the other part. The housing parts have interengaging guide means and resilient latch means securing the housing parts in the second condition.

5 Claims, 4 Drawing Figures

1
2
3
4
5
6

ELECTRICAL CONNECTOR

This invention relates to an electrical connector housing and is concerned with positively retaining contacts in the housing.

In our German Patent Application OLS No. 1,912,825 means were disclosed for releasably securing terminal posts in a connector block and comprising an apertured cover plate movable relative the block to misalign apertures in the plate relative to post cavities in the block and engage the plate with shoulders on the posts.

An electrical connector housing of resilient material according to the present invention comprises first and second housing parts, the first part having a through cavity for receiving a contact portion of a terminal and the second part having a through cavity for receiving a wire connecting the portion of the terminal, the housing parts being assembled with the cavities in general alignment, characterised in that the housing parts are formed with interengaging rectilinear guide means and releasable latch means, the guide means extending transversely of the cavities and being adapted to allow relative sliding movement transversely and resist relative movement longitudinally of the cavities, the latch means securing the housing parts with a shoulder of the second housing part overlapping an edge of the cavity in the first housing part for positively engaging the terminal contact portion.

The invention will now be described by way of example with reference to the accompanying partly diagrammatic drawings, in which.

Figures 1, 2:
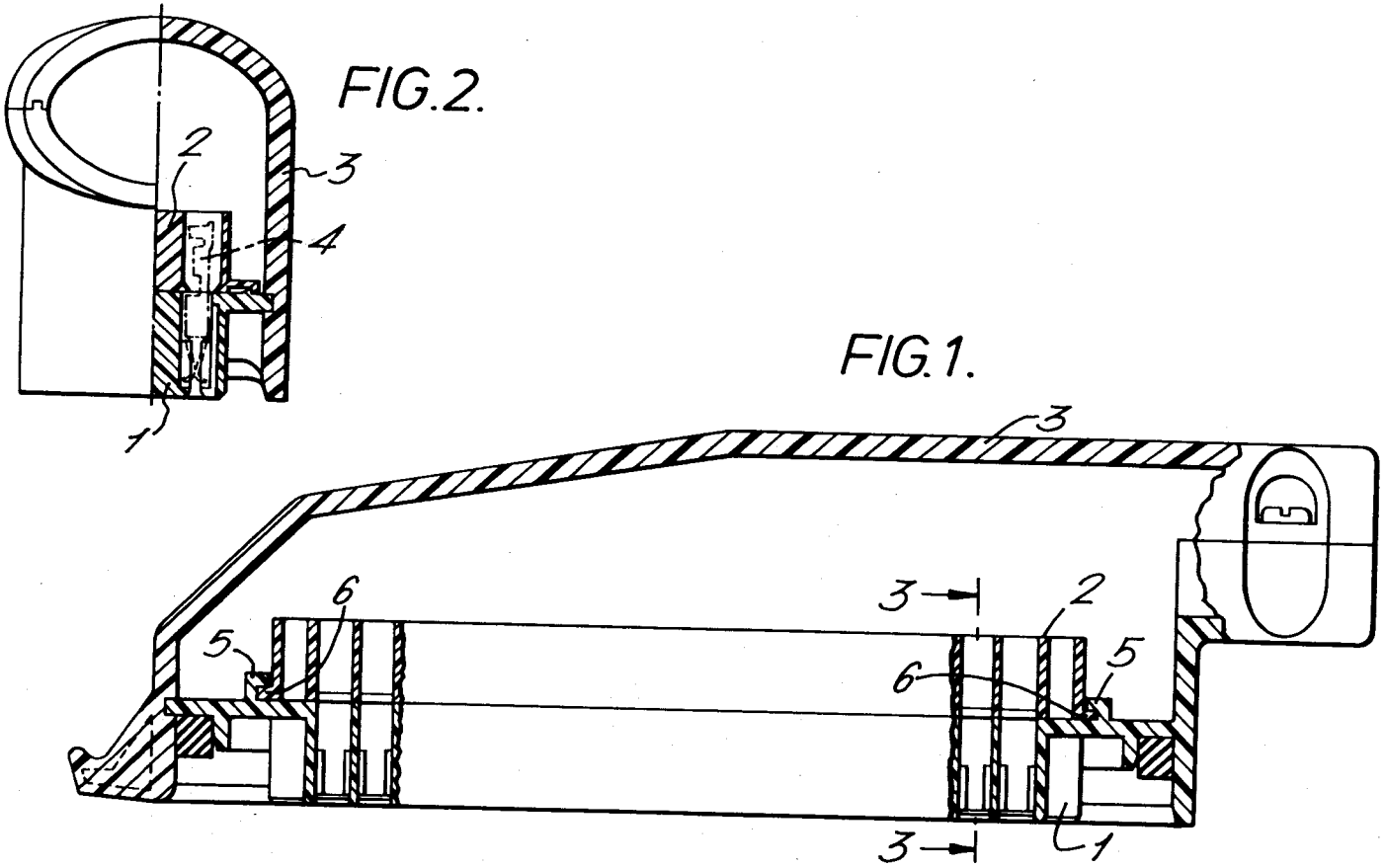
FIG. 1 is a sectional side elevation of an electrical connector.
FIG. 2 is an end view of the connector of FIG. 1, taken from the righthand of that FIG., and half in section.
Figure 3:
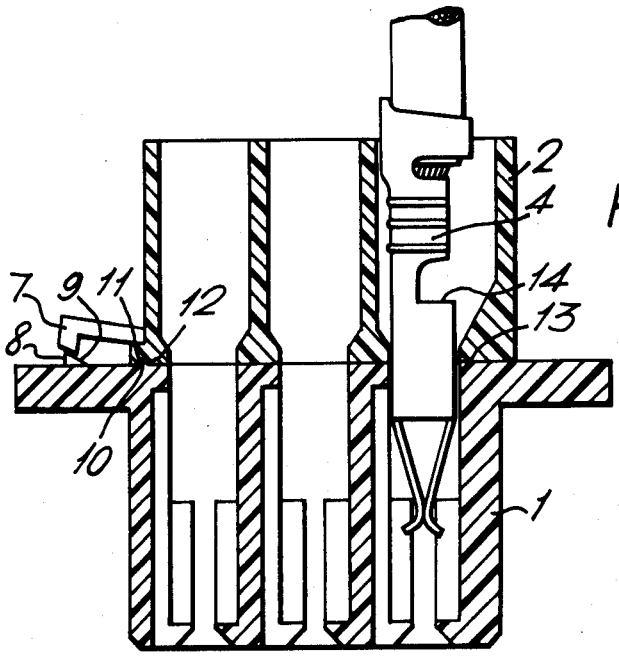
FIG. 3 is a cross-section taken on the line 3—3 of FIG. 1 and to an enlarged scale.
Figure 4:
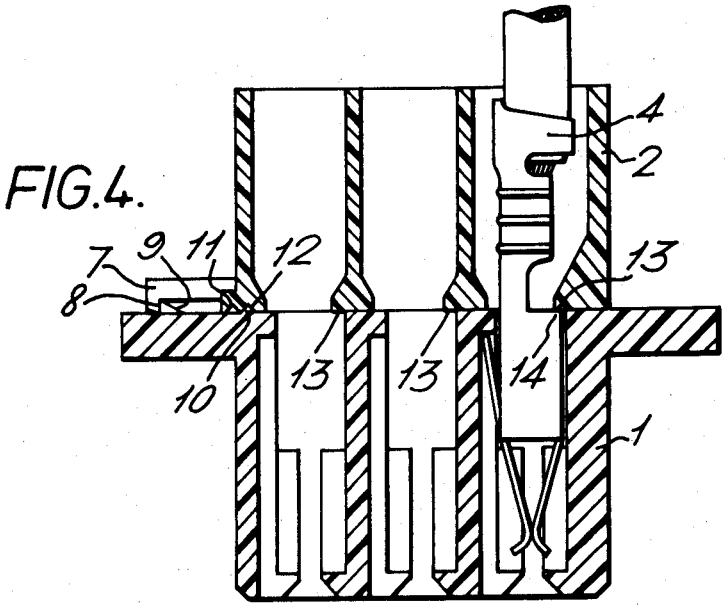
FIG. 4 is a view similar to that of FIG. 3 but with first and second housing parts in a different relative position.

The connector of FIG. 1 comprises first and second housing parts 1, 2 and a cover member 3. The housing parts 1, 2 are provided with a plurality of through cavities, generally aligned to provide through cavities for receiving contacts 4 as shown in FIGS. 2 to 4. The housing part 1 is formed on its upper surface with a pair of parallel guide rails 5 slidably engaging respective ribs 6 at ends of the housing part 2. The rails 5 and ribs 6 resist separation of the housing parts 1, 2 in a direction longitudinally of the cavities, but permit relative movement transversely of the cavities.

As seen in FIGS. 2 to 4, the housing part 2 is formed at one side with a resilient latch arm 7 adapted to engage a shoulder 8 on a flange of the housing part 1. The shoulder 8 is defined by a projection having on a side facing the housing part 2, a ramp surface 9 leading upwardly to the shoulder 8 facing away from the housing part 2. Suitably a pair of latch arms and complementary shoulders is provided spaced lengthwise of the housing parts 1 and 2.

The housing part 1 is formed on its upper face with a V-shaped rib 10, and the housing part 2 is formed on its lower face with a pair of grooves 11, 12 adapted to engage the rib 10 and index the relative position of the housing parts 1, 2 in either of two conditions.

In the event it is necessary to replace a contact 4, the latch arm may be lifted over the shoulder 8, to allow movement of the housing part 2 from the FIG. 4 to the FIG. 3 condition.

In assembling the connector, the housing parts are initially positioned as shown in FIG. 3 with the rib 10 engaging the groove 11 and the end of the latch arm 7 engaging the ramp surface 9. In this condition the cavities in the housing part 2 are aligned with respective cavities of the housing part 1, to allow insertion of contact 4 through the housing part 2 into housing part 1. After insertion of the contact 4 the housing part 2 is moved along the guide rails 5 to disengage the indexing rib 10 from the groove 11 and register it with the groove 12, the latch arm snapping over the shoulder 8 to resist reverse movement. In this condition, shoulder portions 13 of the housing part 2 overlap sides of the cavities in the housing part 1 to engage above shoulders 14 of the contacts to prevent withdrawal of the contacts.

We claim:

1. An electrical connector housing of resilient insulating material including first and second housing parts, the first part having a through cavity for receiving a contact portion of a terminal, and the second part having a through cavity for receiving a wire connecting portion of the terminal, the housing parts being assembled with the cavities in general alignment, the connector housing comprising, interengaging guide means integral with said housing parts including parallel guide rails on one said housing part and cooperating ribs on the other said housing part, wherein said guide rails slidably engage said ribs to allow for relative sliding movement transversely of the cavities between said first and second housing parts to permit adjustment of the alignment between said cavities, said interengaging guide means additionally preventing separation of said first and second housing parts in the direction longitudinal of the cavities, said housing parts being moveable to a relatively offset position in which a portion of said second housing part overlaps an edge of the cavity in said first housing part thereby forming a retaining shoulder for securing and positively engaging a terminal contact therein, and position indexing means for releaseably holding said housing parts in either of two relative positions, one of said positions being said relatively offset position.

2. A connector housing as claimed in claim 1 in which each said housing part includes a plurality of through cavities, and in which portions of the second housing part overlap edge portions of respective cavities of the first part when in said relatively offset position.

3. A connector housing as in claim 1 in which said position indexing means includes a rib on one of the housing parts engageable with either of two grooves on the other housing part.

4. A connector housing as in claim 1 including latch means for securing said housing parts in said relatively offset position, said latch means including a resilient latch arm on one housing part and a shoulder on the other housing part.

5. A connector housing as in claim 4 in which said shoulder associated with said latch means includes a projection having a ramp surface on its side facing the one housing part.

* * * * *